US011105087B1

(12) United States Patent
Bundy

(10) Patent No.: US 11,105,087 B1
(45) Date of Patent: Aug. 31, 2021

(54) PORTABLE COLLAPSIBLE SHELTER

(71) Applicant: Ross Bundy, Caterham (GB)

(72) Inventor: Ross Bundy, Caterham (GB)

( * ) Notice: Subject to any disclaimer, the term of this patent is extended or adjusted under 35 U.S.C. 154(b) by 0 days.

(21) Appl. No.: 17/256,152

(22) PCT Filed: Jul. 4, 2019

(86) PCT No.: PCT/EP2019/068027
§ 371 (c)(1),
(2) Date: Dec. 24, 2020

(87) PCT Pub. No.: WO2020/007997
PCT Pub. Date: Jan. 9, 2020

(30) Foreign Application Priority Data

Jul. 5, 2018 (GB) ..... 1811078

(51) Int. Cl.

| | |
|---|---|
| ***E04B 1/343*** | (2006.01) |
| ***E04H 15/38*** | (2006.01) |
| ***E04H 15/44*** | (2006.01) |
| ***E04H 1/12*** | (2006.01) |

(52) U.S. Cl.
CPC ..... *E04B 1/34373* (2013.01); *E04H 1/1205* (2013.01); *E04H 15/38* (2013.01); *E04H 15/44* (2013.01)

(58) Field of Classification Search
CPC ..... E04B 1/34373; E04B 1/34305; E04H 1/1205; E04H 15/38; E04H 15/46; B60P 3/34; B62D 63/061
See application file for complete search history.

(56) References Cited

U.S. PATENT DOCUMENTS

| | | | | |
|---|---|---|---|---|
| 3,833,954 | A | 9/1974 | Braun et al. | |
| 9,629,444 | B2 | 4/2017 | Isensee | |
| 2004/0016183 | A1* | 1/2004 | Hoffman | E04H 15/52 52/64 |
| 2004/0216395 | A1 | 11/2004 | Wentworth | |
| 2011/0254305 | A1* | 10/2011 | Gogola | B62D 33/08 296/26.13 |
| 2017/0240088 | A1* | 8/2017 | Tait | B60R 9/065 |
| 2018/0087288 | A1 | 3/2018 | Boettiger | |
| 2018/0162259 | A1* | 6/2018 | Lin | B60P 3/39 |

* cited by examiner

*Primary Examiner* — Gisele D Ford
(74) *Attorney, Agent, or Firm* — AEON Law, PLLC; Adam L. K. Philipp; David V. H. Cohen

(57) ABSTRACT

A collapsible shelter comprising a rigid-framed box section and a plurality of rigid panel sections, wherein each panel has a complimentary shape and dimension to fit within a neighbouring section such that the structure can be collapsed to form a storage case when all the panel sections fit within the box section.

20 Claims, 7 Drawing Sheets

PORTABLE COLLAPSIBLE SHELTER

CROSS-REFERENCE TO RELATED APPLICATIONS

This application is a U.S. national phase entry of PCT Application No. PCT/EP2019/068027 filed on Jul. 4, 2019, and naming Ross Bundy as inventor and applicant, which claims priority to UK Patent Application No. GB 1811078.3 filed on Jul. 5, 2018. The above-cited applications are hereby incorporated by reference, in their entireties, for all purposes. The Application Data Sheet filed herewith forms a part of the present application, and all priority documents to which it refers are incorporated by reference herein in their entireties, for all purposes.

FIELD OF INVENTION

The present invention relates to a portable collapsible (or expandable) shelter. In particular the invention relates to a shelter for use by a homeless person for example, which is collapsible when not being used for sleeping to form a case in which to store and carry items, and which can be later expanded to provide a shelter to sleep in when required.

BACKGROUND TO THE INVENTION

Every city in the world has a homeless population that struggle to sleep at night due to outside environment, particularly in winter months. Commonly, the homeless community turn to alcohol or drugs to provide a way of blocking out the cold and hostile environment during the hours of night. Homeless shelters may be available at various locations in the city but these are often difficult to get into as they are limited in the number of homeless they can accommodate at any one time. Many homeless seek to avoid such places due to the large concentration of drug addicts and alcoholics that congregate around them and who can often be physically intimidating.

The present invention seeks to provide a portable, lightweight shelter for inter alia a homeless person that can be easily transported and which can be expanded to construct a shelter in which the homeless person can sleep.

The invention also seeks to provide a shelter that, when not required for sleeping is collapsible to a case-sized structure in which items be stored and transported. The items may be goods that are provided with the shelter, to provide comfort to the homeless person (for example food, clothing or a sleeping bag) or may be items owned by the homeless person, in which case the case provides a means to hold, store and transport those items safely and securely during the day or night.

The invention also seeks to provide a shelter which has its own power source formed as part of the structure which can be used to provide heat, light or ventilation within the shelter.

STATEMENTS OF INVENTION

According to a first aspect there is provided a portable storage case that is expandable to form an elongate structure, the case comprising a rigid-framed box section and a plurality of rigid panel sections each section having a complimentary shape and dimension to fit within a neighbouring section such that all sections fit within the base box section, each panel section being expandable from the box section and from its neighbouring panel section to form an elongate structure providing inter alia a sleeping chamber.

Preferably each panel section is made from a lightweight plastics material.

Preferably the end panel section remote from the box section when the structure is expanded, is hingedly attached to its neighbouring section so to form an openable lid for the case or a door for the elongate structure.

Preferably the end panel section includes window.

Preferably the end panel section includes a securement means to lock the panel section closed when in the expanded or collapsed state.

Preferably the box-section and panel sections have an arcuate structure.

Preferably the case comprises three to eight panel sections.

Preferably still the case comprises six panel sections.

Preferably each panel section has a foot extending downwardly from each corner.

Preferably each foot is provided with a recessed profile so to fit within the foot profile of a neighbouring panel section when the case is in its collapsed state.

Preferably at least one side wall of the box section includes an air vent.

Preferably least one panel section includes an air vent in a side wall.

Preferably a top edge of one side of each panel section is formed with a downwardly curved lip.

Preferably a flexible seal is provided along the edge of curved lip to provide seal between neighbouring panels when the case is expanded.

Preferably each panel section is joined to the neighbouring section by the flexible seal.

Preferably the box section is secured to a wheeled frame.

Preferably the frame includes a handle.

Preferably the wheels are supported either side of an axle.

Preferably the axle is offset from the base of the box section.

Preferably a dynamo is secured to the axle and powered through rotation of the wheels.

Preferably the dynamo provides power to the supply, light, heat or ventilation to the elongate structure.

Preferably the frame further includes a battery to store electricity generated from the dynamo whilst the case is transported by its wheels.

Preferably the wheels are removable from the frame.

According to a second aspect there is provided an elongate structure providing inter alia a sleeping chamber, the structure comprising a rigid-framed box section and a plurality of rigid panel sections, wherein each panel has a complimentary shape and dimension to fit within a neighbouring section such that the structure can be collapsed to form a storage case when all the panel sections fit within the box section.

Preferably the structure has a length, when expanded, of between 2 m and 2.5 m.

Preferably the structure has a height, when expanded, of between 0.9 m and 1.1 m.

Preferably the structure has a width, when expanded, of between 0.5 m and 0.7 m.

BRIEF DESCRIPTION OF THE DRAWINGS

One embodiment of the invention will now be described by way of example only, with reference to the accompanying figures in which.

DETAILED DESCRIPTION OF PREFERRED EMBODIMENTS

Figure 1:
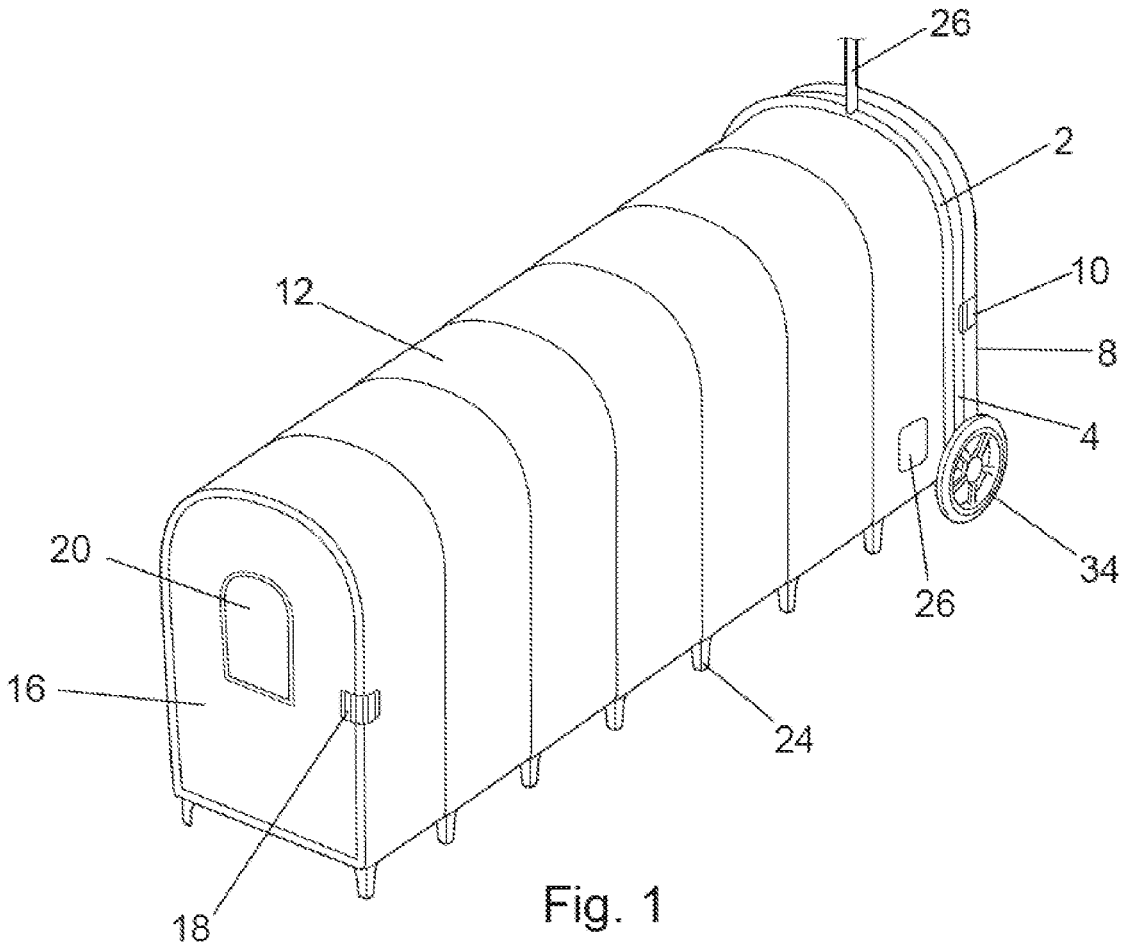
FIG. 1 is a perspective schematic view of a shelter constructed in accordance with the invention in expanded form.
Figure 3:
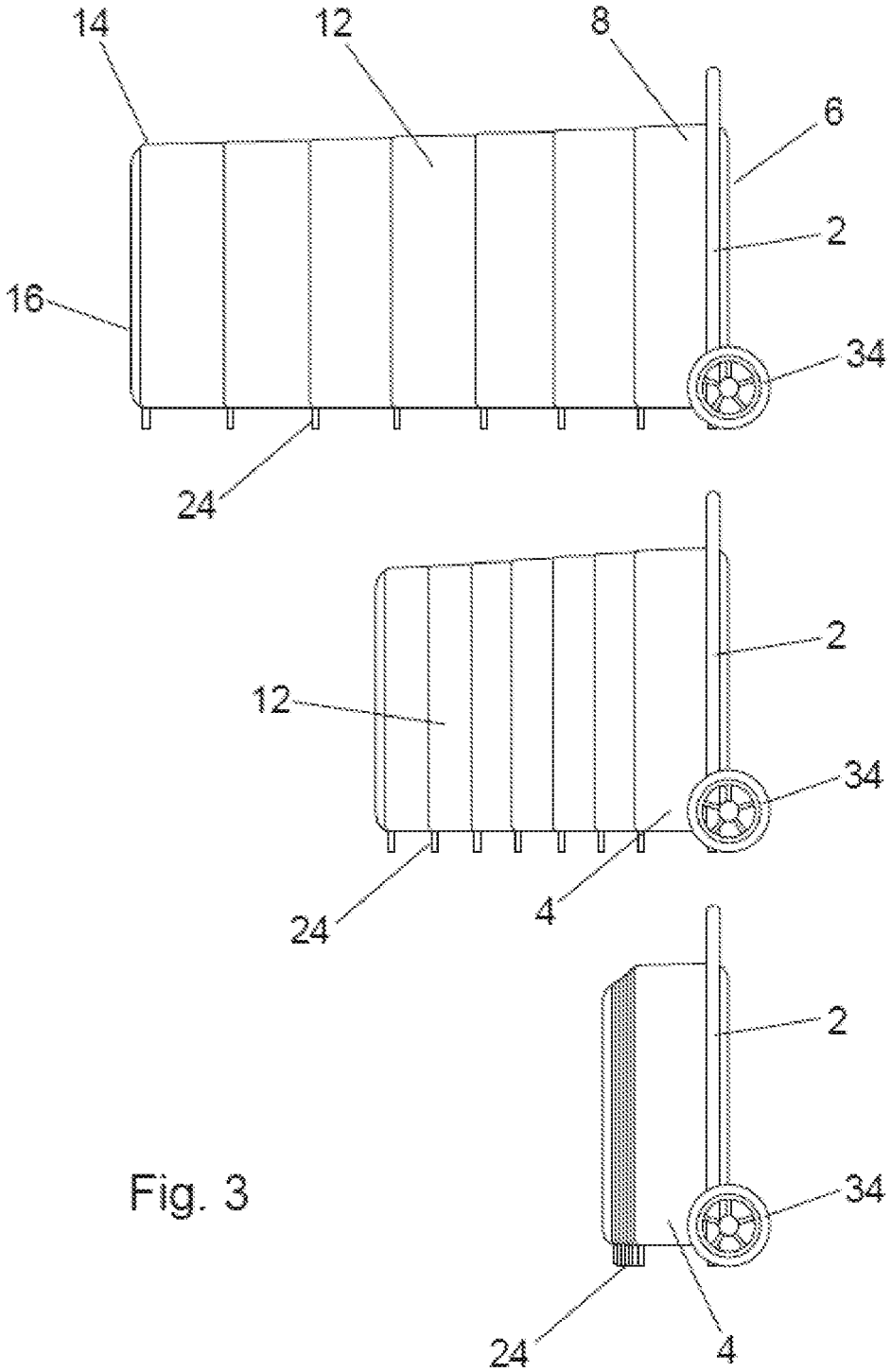
FIG. 3 shows the shelter of FIG. 1 in its various expanded states.

A portable lightweight shelter, suitable for providing an in situ sleeping chamber for a homeless person during night hours is shown in FIGS. 1 and 3.

The shelter comprises a frame 2 at one end to which is secured a base box-section 4 having a base 6 and side walls 8. In the figures provided, and in general use, the box section 4 is orientated on its side so that the base 6 forms the closed end wall of the shelter. The base 6 and side walls 8 are constructed from a rigid plastics material. Alternatively the box section 4 may be constructed from a rigid frame whilst the walls may be formed from a flexible or fabric material.

The base 6 of the box section is pivotal about a hinge 10 to provide a door or entrance into the shelter from that end.

The shelter further includes a plurality of panel sections 12 that are joined together and sit adjacent each other when the shelter is in its expanded form.

Each panel section 12 is constructed from a fairly rigid plastics material to provide an element of stability and security to the overall shelter construction.

In FIG. 1 the shelter has a further six arched panel sections forming a shelter approximately 7 ft (2.1 m) long, 2 ft (0.6 m) wide and around 3 ft (0.9 m) high. This provides sufficient length and width to accommodate an average person comfortably within the shelter during the night.

The shelter may be constructed of any number of panel sections 12 to provide a shelter of varying length and dimensions. The panel sections 12 may be of any suitable material which provides a stable secure structure.

Each panel section 12 has an arcuate structure and has a complimentary shape and dimension to fit within a neighbouring section such that all sections fit within the base box section 4 when the shelter is collapsed to its storage case form.

The end panel section 14 remote from the frame 2 is pivotal about its neighbouring panel section 14 via a hinge 18 to provide a door 16 to enter the shelter from that end. When the shelter is collapsed into a storage case form the door 14 provides a lid for the case.

The door 16 includes a window 20. A window 22 may also be provided in the base 6 of the box-frame section 4. The or each door may have locking means accessible from the inside and/or outside to ensure that the person sleeping within the shelter, and their belongings, are secure during the night. The locking means also keeps the storage case secure to prevent access to any belongings inside during the day.

One side of each panel section 12 has a foot 24 extending downwardly from each corner. The feet 24 ensure that the shelter is raised slightly above the ground to allow ease of expansion and collapsing.

An air vent 26 is provided in the side wall of the box-frame section 4. Similar vents may be provided in the side walls of one or more of the panel sections 12 to provide ventilation into the shelter during warmer days or nights.

The top edge of one side of each arched panel section 12 is formed with a downwardly curved lip 28. The downwardly curved lip 28 is provided on the side edge facing towards the base box-frame section 4.

Figure 2:
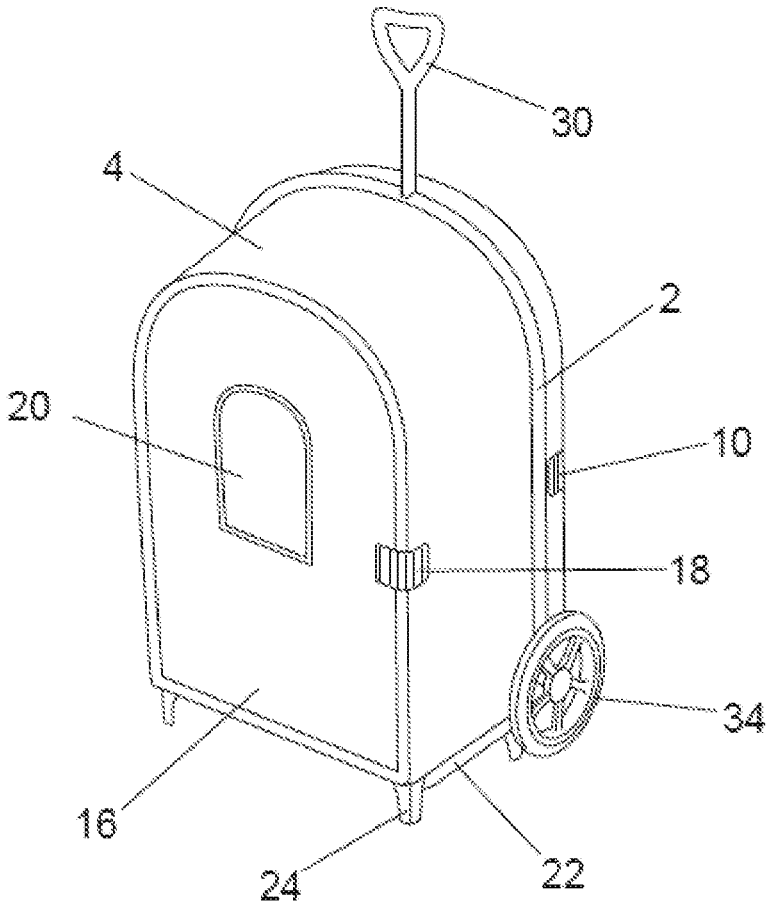
FIG. 2 is a perspective schematic view from one side of the shelter of FIG. 1 in its collapsed state.

The curvature of the lip 28 on one side of the panel sections 12 each allow panels 12 to be pushed against and into its neighbouring panel 12 so to collapse the shelter when sleeping is not required. When fully collapsed, all the panels 12 fit into the base box frame 4, as can be seen in FIG. 2.

Each foot 24 is provided with a recessed profile that allows each foot 24 to fit within the recess of an adjacent foot 24 on a neighbouring panel section 12 when the shelter is collapsed as can be seen in FIG. 3.

The box frame section 4 which holds all the panel sections 12 when the shelter is collapsed, is approximately the size of a large case and is easily stored and transportable. The fact that each panel section 12 is arched forming a structure having side walls and a ceiling but no floor means that when all the panel sections 12 located are within the box-section 4 they follow the internal peripheral profile of the box-section 4 leaving centre of the box-section 4 clear for items to be located, stored and transported.

FIG. 3 shows the shelter in various states of collapse. The panel sections 12 are joined together by flexible seals made from rubber, for example. The seals help to make the shelter water proof. A rubber seal may, for example be provided along the edge of the lip 24 and extend between that edge and the opposing edge of the neighbouring panel section 12.

Figure 4:
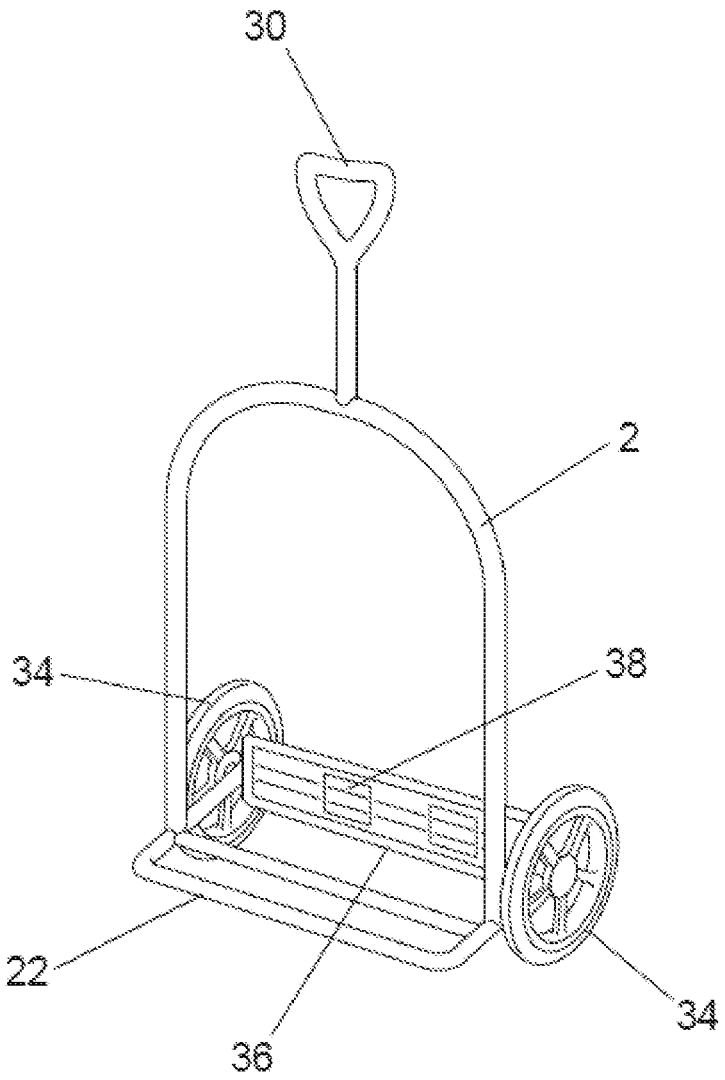
FIG. 4 shows a frame section of the shelter of FIGS. 1 and 2.

The frame 2 on which the box-section 4 is secured is shown in FIG. 4. The top of the frame 2 forms a handle 30. The bottom of the frame 2 has a base section 32 to support the base of the box section 4. Offset from the base support 32, are wheels 34 supported either side of an axle 36. Built into or on the axle 36 is a dynamo 38, or other similar small power generator, which generates electrical power through rotation of the wheels 34. A battery may be provided on the frame to store energy produced while the wheels 34 are turning as the storage case is being pulled along on the ground.

The dynamo 38 provides lighting, heating or ventilation within the shelter. It may also be used, for example, to provide charge for a mobile phone or tablet.

Heating may be provided by placing a heating mesh on the floor of the shelter. LED light strips may applied to the internal walls of the shelter to provide light. A fan may be provided to circulate air within the shelter during warmer nights.

As can be seen in FIG. 3, in the expanded state, the base support frame 32 is offset from the wheel axle 36. This allows the wheels 34 to be freely rotated whilst the shelter is expanded, to power the dynamo 38 if further light, heat or air circulation is required.

When expanded the base frame 2 stabilises the shelter by holding the box-section 4 in the correct orientation for the shelter to rest horizontally above the ground.

The wheels 34 on the frame 2 allow the collapsed shelter to be transported easily to different locations by pulling the frame 2 across the ground by the handle 30.

Figure 5:
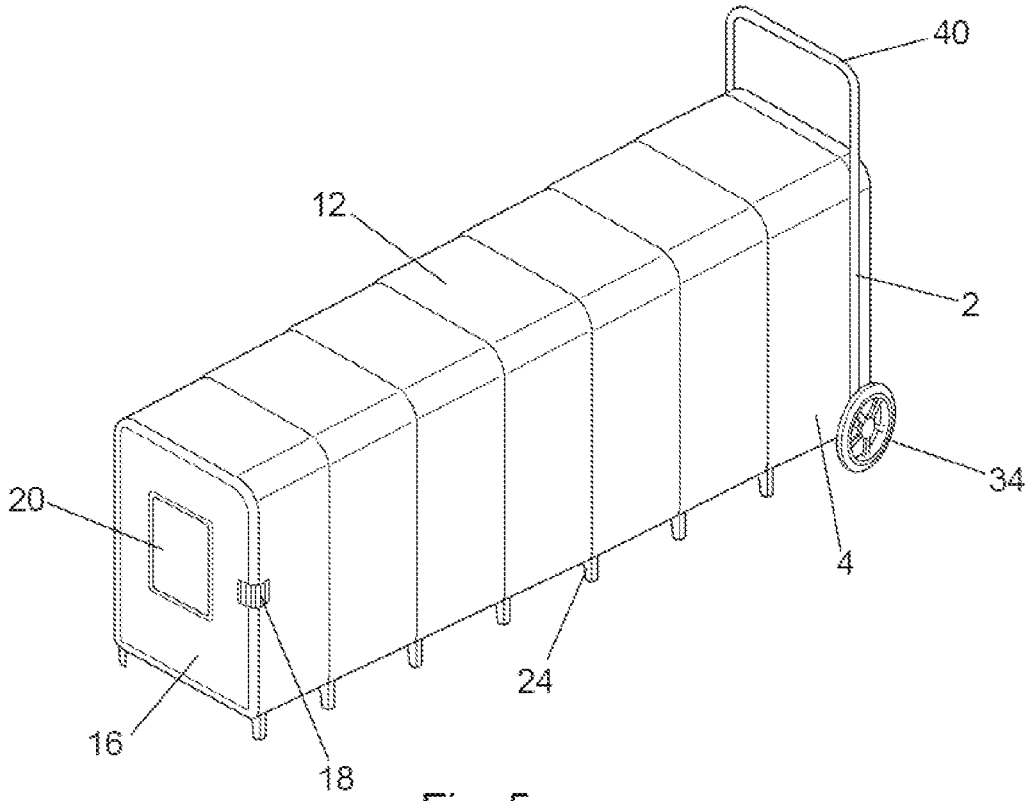
FIG. 5 is a perspective view of a shelter constructed in accordance with a further embodiment of the invention.
Figure 6:
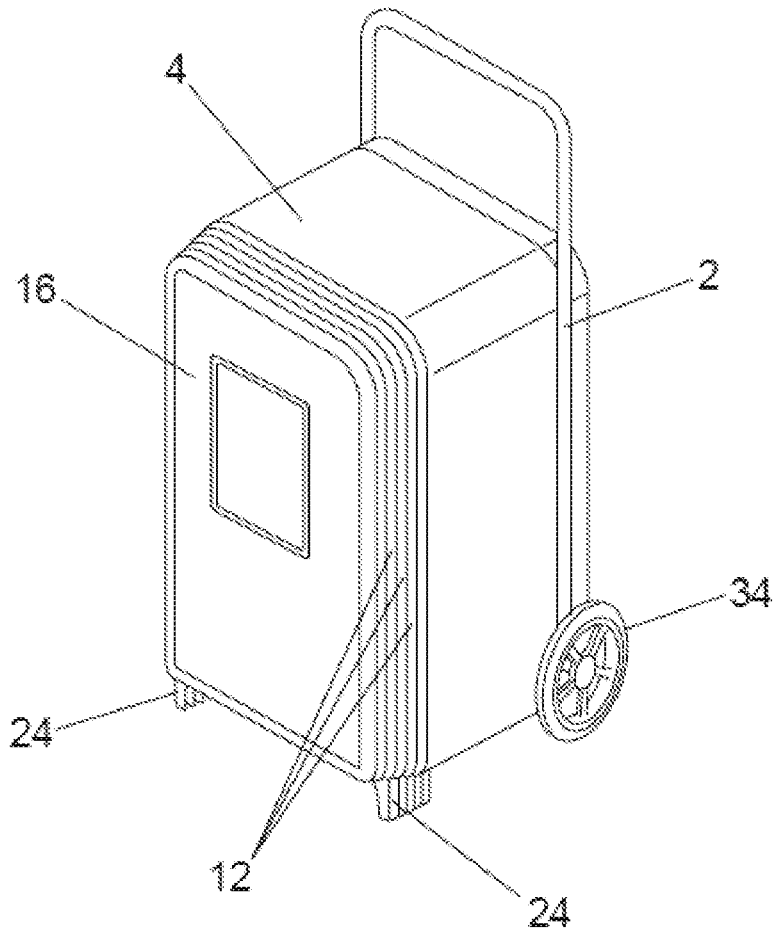
FIG. 6 is a perspective schematic view from one side of the shelter of FIG. 5 in its collapsed state.
Figure 7:
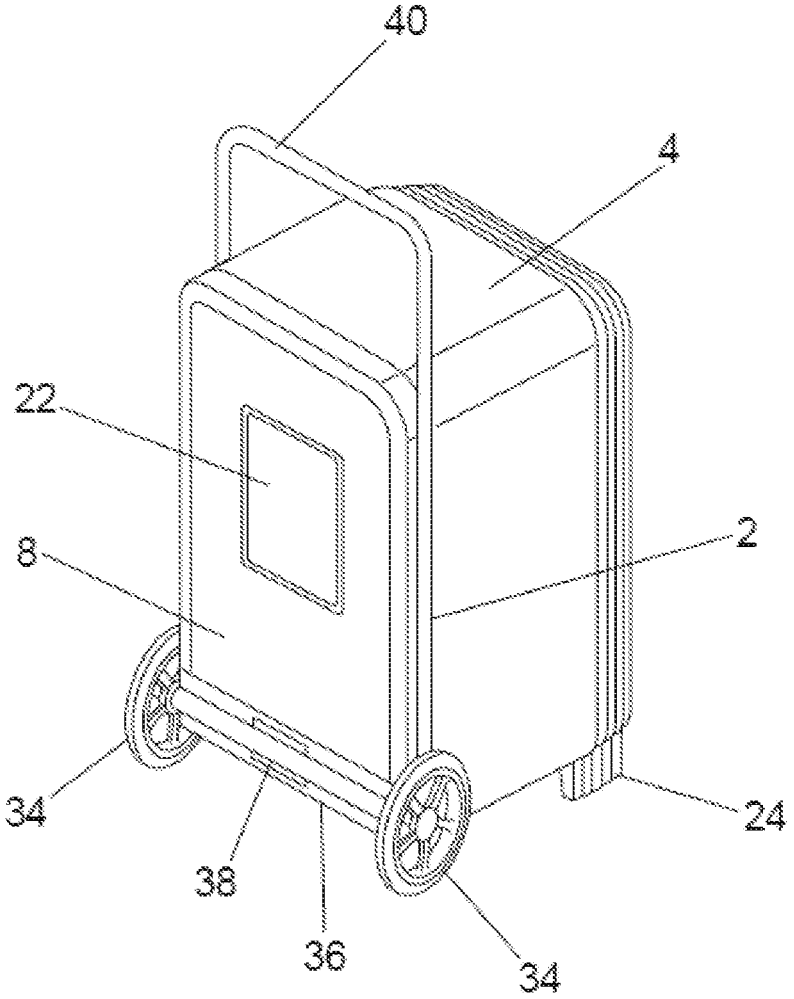
FIG. 7 shows the collapsed shelter of FIG. 6 from the other side.

FIGS. 5 to 7 illustrate a further embodiment. In this embodiment the handle 40 of the frame is a different design to provide improved portability.

The frame 2 and panel sections 12 are formed from lightweight materials to increase portability. Whilst a rigid or semi-rigid material is preferable for stability, the shelter could be formed of a canvas material or the like having sections that collapse or fold together to collapse the shelter.

The wheels 34, axle 36 and dynamo 38 may be removable from the frame 2 to allow the case to be carried more easily.

The invention claimed is:

1. A portable storage case that is expandable to form an elongate structure, the case comprising a rigid-framed box section and a plurality of rigid panel sections with corners, each section having a complimentary shape and dimension to fit within a neighbouring section such that all sections fit within the base box section, each panel section being expandable from the box section and from its neighbouring panel section to form an elongate structure providing a sleeping chamber, wherein each panel section has a foot extending downwardly from each corner and wherein each foot is provided with a recessed profile so to fit within the recess of a foot of a neighbouring panel section when the case is in its collapsed state.

2. A case according to claim 1, wherein each panel section is made from a plastics material.

3. A case according to claim 1, wherein the end panel section remote from the box section when the structure is expanded, is hingedly attached to its neighbouring section so to form an openable lid for the case or a door for the elongate structure.

4. A case according to claim 3, wherein the end panel section includes a window.

5. A case according to claim 3, wherein the end panel section includes a securement means to lock the panel section closed when in the expanded or collapsed state.

6. A case according to claim 1, wherein the box-section and panel sections have an arcuate structure.

7. A case according to claim 6, comprising three to eight panel sections.

8. A case according to claim 7 comprising six panel sections.

9. A case according to claim 1, wherein at least one side wall of the box section includes an air vent.

10. A case according to claim 1, wherein at least one panel section includes an air vent in a side wall.

11. A case according to claim 1, wherein a top edge of one side of each panel section is formed with a downwardly curved lip.

12. A case according to claim 11, wherein a flexible seal is provided along the edge of curved lip to provide seal between neighbouring panels when the case is expanded.

13. A case according to claim 12, wherein each panel section is joined to the neighbouring section by the flexible seal.

14. A case according to claim 1, wherein the box section is secured to a wheeled frame.

15. A case according to claim 14, wherein the frame includes a handle.

16. A case according to claim 14, wherein the wheels are supported either side of an axle.

17. A case according to claim 16, wherein the axle is offset from the base of the box section.

18. A case according to claim 16, comprising a dynamo secured to the axle and powered through rotation of the wheels.

19. A case according to claim 18, wherein the dynamo provides power to the supply, light, heat or ventilation to the elongate structure.

20. A case according to claim 18, wherein the frame further includes a battery to store electricity generated from the dynamo whilst the case is transported by its wheels.

* * * * *